US006582144B1

(12) United States Patent
Matsumoto et al.

(10) Patent No.: US 6,582,144 B1
(45) Date of Patent: Jun. 24, 2003

(54) WRITING IMPLEMENT

(75) Inventors: Kazuaki Matsumoto, Yokohama (JP); Hiroyuki Mutou, Yokohama (JP); Takeshi Kobayashi, Yokohama (JP)

(73) Assignee: Mitsubishi Pencil Kabushikikaisha, Tokyo (JP)

( * ) Notice: Subject to any disclaimer, the term of this patent is extended or adjusted under 35 U.S.C. 154(b) by 0 days.

(21) Appl. No.: 10/030,811

(22) PCT Filed: Jul. 19, 2000

(86) PCT No.: PCT/JP00/04846

§ 371 (c)(1),
(2), (4) Date: Jan. 14, 2002

(87) PCT Pub. No.: WO01/05604

PCT Pub. Date: Jan. 25, 2001

(30) Foreign Application Priority Data

Jul. 19, 1999 (JP) ..... 11-204007

(51) Int. Cl.[7] ..... B43K 5/10; B43K 5/18; B43K 7/10

(52) U.S. Cl. ..... 401/209; 401/224; 401/227; 401/229

(58) Field of Search ..... 401/227, 224, 401/225, 229, 209

(56) References Cited

U.S. PATENT DOCUMENTS

| | | | | |
|---|---|---|---|---|
| 4,522,525 A | * | 6/1985 | Saito et al. | 401/258 |
| 4,645,367 A | | 2/1987 | Mutschler et al. | 401/199 |
| 4,728,214 A | | 3/1988 | Mutschler | 401/258 |
| 4,968,169 A | * | 11/1990 | Yokosuka et al. | 401/227 |
| 5,829,904 A | * | 11/1998 | Matsumoto et al. | 401/209 |
| 5,957,608 A | * | 9/1999 | Matsumoto et al. | 401/213 X |

FOREIGN PATENT DOCUMENTS

| | | |
|---|---|---|
| EP | 0 469 465 B1 | 5/1995 |
| JP | 57-162879 U | 10/1982 |
| JP | 61-39589 Y2 | 11/1986 |
| JP | 61-40543 Y2 | 11/1986 |
| JP | 2-32154 B2 | 7/1990 |
| JP | 2-33313 B2 | 7/1990 |
| JP | 5-507245 A | 10/1993 |
| JP | 2524018 B2 | 5/1996 |
| WO | 91/19615 A1 | 12/1991 |

* cited by examiner

*Primary Examiner*—Gregory Huson
*Assistant Examiner*—Kathleen J. Prunner
(74) *Attorney, Agent, or Firm*—Kubovcik & Kubovcik

(57) ABSTRACT

A writing implement for preventing ink from leaking out from a front end of a tip by absorbing much of a change in pressure inside an ink tank, the implement being a direct liquid type writing implement having an ink tank and an ink flowing portion connecting the ink tank and a writing end, a temporary ink reserve part for temporarily holding ink and an air supplying portion for supplying air to the temporary ink reserve part, the temporary ink reserve part being constituted by a temporary ink reserve groove and an ink guide groove, an ink introducing groove at a vicinity of the ink tank constituting a portion of the ink guide groove, a distance from the writing end to an end portion of the temporary ink reserve groove on its ink tank side being larger than a distance from the writing end to the ink introducing groove.

8 Claims, 11 Drawing Sheets

PRIOR ART

PRIOR ART

WRITING IMPLEMENT

TECHNICAL FIELD

The present invention relates to a writing implement of a direct liquid type such as a ballpoint pen, a felt-tip pen or the like, further particularly to a writing implement having a temporary ink reserve part, between a tip and the ink tank, for adjusting a variation in pressure inside an ink tank.

BACKGROUND OF THE INVENTION

Conventionally, there has been provided a writing implement such as a ballpoint pen having a collector forming a temporary ink reserve part, between a tip and an ink tank, for adjusting a variation in pressure inside the ink tank.

An explanation will be given to a conventional writing implement of this kind in reference to an illustrated example.

FIG. 10 is a sectional side view of essential portions of a conventional ballpoint pen and FIG. 11 is a sectional side view of a collector.

Around an outer periphery of the collector 100, there are provided ink guide grooves 130 deposited from an ink tank 120 toward a tip 110 forming a writing end, air grooves 140 deposited from the tip 110 to the ink tank 120 so as not to intersect with the ink guide grooves 130, and a number of temporary ink reserve grooves 150 formed to intersect with the ink guide grooves 130 and the air grooves 140. A temporary ink reserve part is formed by the ink guide grooves 130, the air grooves 140, and the temporary ink reserve grooves 150.

Further, at a center of the collector 100 there is provided an ink guide hole 160 penetrated from an end portion of the ink tank 120 to an end portion of the tip 110. Further, the ink guide hole 160 is inserted with an ink guide core 161 to guide ink from the ink tank 120 to the tip 110.

Further, the collector 100 is provided with a number of fins 170 provided to narrow intervals therebetween. Further, the temporary ink reserve groove 150 is formed by gaps between the fins 170. Further, the ink guide grooves 130 and the air grooves 140 are formed to penetrate the fins 170.

A further explanation will be given to the collector 100 as follows.

The temporary ink reserve groove 150 is formed by the gaps of a number of the fins 170 provided by the collector 100.

Further, the ink guide groove 130 is formed to penetrate a number of the fins 170 from the ink tank 120 to the tip 110, and communicates with the temporary ink reserve groove 150 and the ink tank 120. Further, at an end portion of the ink guide groove 130 on the side of the tip 110, there is provided a tip-side projecting portion 180, and by the tip-side projecting portion 180, the ink guide grooves 130 are prevented from directly communicating with outside of the ballpoint pen. Further, a rear end position of the collector 100 where the ink guide grooves 130 open to the ink tank 120 is made to constitute an air exchanging portion 135 where open airflows into the ink tank 120. Further, a width of the ink guide groove 130 is formed to be narrower than a width of the temporary ink reserve groove 150.

Further, the air groove 140 is formed to penetrate a number of the fins 170 from the tip 110 to the ink tank 120, and communicates with the temporary ink reserve groove 150 and outside of the ballpoint pen. Further, at an end portion of the air groove 140 near the ink tank 120, there is provided an ink-tank-side projecting portion 190, and by the ink-tank-side projecting portion 190, the air groove 140 is prevented from directly communicating with the ink tank 120. Further, a width of the air groove 140 is formed to be wider than a width of the temporary ink reserve groove 150.

Next, an explanation will be given to a function or the like of the collector 100.

The ink inside the ink tank 120 is normally guided to the tip 110 by the capillary force of the ink guide core 161 inserted into the ink guide hole 160.

Further, when the pressure inside the ink tank 120 increases relatively to the atmospheric pressure by a rise of temperature of ink or the like inside the ink tank 120 or by a variation in the atmospheric pressure, the ink inside the ink tank 120 is conducted through the ink guide groove 130 and reaches the temporary ink reserve groove 150. Therefore, even when the pressure inside the ink tank 120 increases relatively to the atmospheric pressure by the variation in the pressure inside the ink tank 120, the ink does not leak out from a front end of the tip 110.

Further, when the pressure inside the ink tank 120 reduces relatively to the atmospheric pressure by consuming the ink inside the ink tank 120, by temperature fall of ink or the like inside the ink tank 120, or by the variation in the atmospheric pressure, the ink inside the temporary ink reserve groove 150 is conducted through the ink guide groove 130 and flows into the ink tank 120 to increase pressure inside the ink tank 120. Therefore, even when the pressure inside the ink tank 120 reduces relatively to the atmospheric pressure by the variation in the pressure inside the ink tank 120, the ink soaked in the ink guide core 160 cannot be drawn into the ink tank 120.

Further, when the pressure inside the ink tank 120 reduces and an amount of ink inside the temporary ink reserve groove 150 is very little, the air outside the ballpoint pen is conducted through the air grooves 140, the temporary ink reserve grooves 150 and the ink guide grooves 130, flowing from the air exchanging portion 135 into the ink tank 120 to increase the pressure inside the ink tank 120. Therefore, even when the pressure inside the ink tank 120 is reduced, the ink soaked in the ink guide core 161 cannot be drawn into the ink tank 120.

In this way, the collector 100 achieves a function of stably supplying ink from the ink tank 120 to the tip 110 by adjusting a variation in pressure inside the ink tank 120.

Meanwhile, when a total length of the above-described collector is extended, a capability of adjusting with regard to the variation in pressure inside the ink tank can be promoted. However, on the other hand, a distance from the front end of the tip to a rear end of the ink guide groove 130 is prolonged, and, when the front end of the writing implement is directed downwardly, head pressure applied to the front end of the tip is increased. Therefore, there poses a problem that the constitution operates adversely to leaking out of ink from the front end of the tip.

Conversely, when the total length of the collector is shortened, although ink can be prevented from leaking out from the front end of the tip, there poses, on the other hand, a problem that the capability of adjusting with regard to the variation in pressure inside the ink tank is reduced.

Therefore, there has been requested a writing implement of a direct liquid type in which, even when a total length of the collector is extended, the ink is not leaked out from a front end of a tip.

Hence it is an object of the invention described in claim 1 to provide a writing implement capable of preventing a pressure adjusting function from reducing while reducing head pressure applied to an ink guide core by disposing an air exchanging portion to a writing end rather than a position of a rear end of a temporary ink reserve part.

It is also an object of the invention described in claim 1 to provide a writing implement in which air is not hampered from flowing into an ink tank, and an ink solution communicates excellently with a temporary ink reserve part and which is provided with prompt response performance in adjusting pressure inside the ink tank.

Further, it is an object of the invention described in claim 1 to provide a writing implement for forming always stable head pressure by disposing the air exchanging portion always at a constant position and disposing the air exchanging portion firmly to a side of the writing end rather than the rear end portion of the temporary ink reserve groove.

Further, it is an object of the invention described in claim 4 to provide a writing implement forming the air exchanging portion swiftly and firmly by making an ink solution flow in addition to the above-described objects of the invention.

Further, it is an object of the invention described in claim 5 to provide a writing implement for facilitating to form an ink guide groove in addition to the above-described respective objects of the invention.

Further, it is an object of the invention described in claim 6 in the present invention to provide a writing implement such as a ballpoint pen for preventing ink from leaking out from a front end of a tip even when a total length of a collector is prolonged by constituting a collector formed with a temporary ink reserve part and the like by a principal portion, a partitioning portion provided continuously to the principal portion on its side to the ink tank and an extended portion provided continuously to the partitioning portion on its side to the ink tank, providing an air exchanging hole communicating with the ink guide groove at an outer periphery of the partitioning portion and providing an ink introducing groove continuous to the air exchanging hole at an outer periphery of the extended portion.

Further, it is an object of the invention described in claim 7 in the present invention to provide a writing implement for making air bubbles inside the ink guide groove flow swiftly to the ink tank by forming the ink guide groove such that the tip side is made shallow and ink tank side is made deep in addition to the object of the invention described in claim 6.

Further, it is an object of the invention described in claim 8 in the present invention to provide a writing implement for filling the ink introducing groove swiftly with ink by providing a face-cut portion at a surrounding of the ink introducing groove in addition to the object of the invention described in claim 6 or claim 7.

DISCLOSURE OF THE INVENTION

According to the invention described in claim 1 in the invention, there is provided a writing implement which is a writing implement of a direct liquid type having an ink tank (30) and having an ink flowing portion for connecting the ink tank (30) and a writing end (20), a temporary ink reserve part for temporarily holding ink and an air supplying portion for supplying air at the temporary ink reserve part, wherein the temporary ink reserve part comprises lateral grooves for constituting a plurality of temporary ink reserve grooves (52, 72) for temporarily holding ink by a capillary force, and vertical grooves constituting ink guide grooves (51, 71) for enabling to exchange air to inside of the ink tank (30) while communicating the temporary ink reserve groove (52, 72) and the ink tank (30) and by constituting an ink introducing groove (71) by a portion at a vicinity of the ink tank (30) constituting a portion of the ink guide groove (51, 71) a distance G from the writing end (20) to an end portion of the temporary ink reserve groove (52, 72) on a side thereof to the ink tank (30) and a distance H from the writing end (20) to the ink introducing groove (71) of the ink guide groove (51, 71), is brought into a relationship shown below:

G>H.

Here, a "temporary ink reserve groove (52, 72)" is a slender gap formed in a ring-like shape centering on a center line of the writing implement and is formed by a number of pieces of slender gaps formed along the center line of the writing implement.

Further, an "ink guide groove (51, 71)" is a slender groove formed from a side of the ink tank (30) to a side of the tip (20) and penetrates the temporary ink reserve groove (52, 72). Further, the ink guide groove (51, 71) is formed not to communicate directly with outside of the writing implement. Further, a large portion of the ink guide groove (51, 71) is formed substantially similar to the ink guide groove (130) provided at the conventional collector (100) and a portion thereof at a vicinity of the ink tank (30) is constituted by the ink introducing groove (71) constituting the wide groove.

Further, an "air supplying portion" is formed by a groove formed from the side of the tip (20) to the side of the ink tank (30) by penetrating the temporary ink reserve groove (52, 72) while being prevented from intersecting with the ink introducing groove (51, 71). Further, the air supplying portion is not directly opened to the ink tank (30) and communicates with outside of the writing implement.

Further, a "writing end (20)" is a front end of a ballpoint pen or a felt-tip pen and is a portion for writing diagrams or characters by coating ink on paper or the like.

In this way, by making the distance G from the writing end (20) to the end portion of the temporary ink reserve groove (52, 72) on the side to the ink tank larger than the distance H from the writing end (20) to the ink introducing groove (71) of the ink guide groove (51, 71), head pressure applied on an ink guide core is reduced, thereby, ink can be prevented from leaking from the writing end (20).

Further, the invention described in claim 1 is characterized in that the ink introducing groove (51) is constituted by a slender groove opening to a number of the temporary ink reserve grooves (52) and forming a meniscus by ink at the ink introducing groove (71) and a wide groove (71) for releasing ink from a capillary force of the slender groove, the ink introducing groove (71) constituted by the wide groove (71) is formed from a side of the ink tank (30) by an arbitrary depth, a portion at a boundary between the wide groove (71) and the slender groove (51), constitutes an air exchanging hole (61) having a small section and is of a size to a degree by which a coagulating force of an ink solution produced inside the wide groove (71) does not hamper air bubbles supplied from the air exchanging hole (61) constituting the boundary portion from being bloated up.

Here, a "meniscus" refers to a state for hermetically sealing a slender groove or a slender gap by filling the slender groove or the slender gap by the ink solution by surface tension or capillary force of the ink solution.

Therefore, the ink introducing groove (71) constituted by the wide groove in the ink guide groove (51, 71) can restrict air communication between the temporary holding groove (52) and the ink tank (30) while passing air bubbles and can make the ink solution flow between the temporary ink reserve groove (52) and the ink tank (30) in accordance with inner pressure of the ink tank (30).

Further, the invention described in claim 1 is characterized in that a total of an opening portion (78) to the temporary ink reserve groove (72) communicated from the ink introducing groove (71) constituted by the wide groove is constituted by a very small groove (78) having a very small section and is made airtight by a meniscus of ink and a meniscus of the air exchanging hole (61) is easy to destruct more than the meniscus of the very small groove (78).

Therefore, outside air supplied to the temporary ink reserve groove (52, 72) via the air supplying portion and supplied from the temporary ink reserve groove (52, 72) to the ink tank (30) via the ink guide groove (51, 71), necessarily passes through the air exchanging hole (61), becomes air bubbles from the ink introducing groove (71) constituted by the wide groove and supplied to the ink tank (30).

Further, the invention described in claim 4 is characterized in that, in the invention described in claim 1, there is provided an ink supply groove (77) for supplying ink from the temporary ink reserve groove (52, 72) to the opening portion to the wide groove (71) and the ink introducing groove (71) constituted by the wide groove is provided with a slender gap as an ink guide gap (79).

Here, an "ink supply groove (77)" is provided over an entire length of the ink introducing groove (71) in the ink introducing groove (71) constituted by the wide groove and firmly forms the meniscus at the very small groove (78) by filling the ink solution.

Further, an "ink introducing gap (79)" is provided over the entire length of the ink introducing groove (71) and guides the ink solution to the ink introducing groove (71) by capillary force.

Therefore, ink from the ink tank (30) can swiftly be filled in the ink introducing groove (71).

Further, the invention described in claim 5 is characterized in that, in the invention described in claim 4, the ink guide groove (71) constituted by the wide groove and the temporary ink reserve groove (72) opened to the wide groove (71) are separated by a partition wall (74) forming an opening portion to the wide groove (71) by a very small interval (78) communicating with the temporary ink reserve groove (72), a corner portion of the partition wall (74) on a side thereof to the wide groove (71) is subjected to face-cutting and the ink supply groove (77) having a strong boundary tension with ink is formed by an apex portion of a wedge-shaped space formed by the face-cut portion (76) and an inner face of an axial cylinder.

Therefore, the ink supplying groove (77) is easy to form and the meniscus can be formed swiftly and firmly.

Further, according to the invention described in claim 6 in the invention, there is provided a writing implement having a collector (10) for adjusting a change in a pressure inside an ink tank (30) between a tip (20) and the ink tank (30), wherein the collector (10) includes a principal portion (50), a partitioning portion (60) provided continuously to the principal portion (50) on a side thereof to the ink tank (30) and an extended portion (70) provided continuously to the partitioning portion (60) on a side thereof to the ink tank (30), wherein at an outer periphery of the principal portion (50), there are provided an ink guide groove (51) formed from a side of the ink tank (30) to a side of the tip (20), a principal-portion air groove (53) formed from the side of the tip (20) to the side of the ink tank (30) while being prevented from intersecting with the ink guide groove (51) and a principal-portion temporary ink reserve groove (52) formed to intersect with the ink guide groove (51) and the principal-portion air groove (53), at an outer periphery of the partitioning portion (60), there are formed an air exchanging hole (61) formed continuously to the ink guide groove (51) and a partitioning-portion air groove (62) formed continuously to the principal-portion air groove (53) while being prevented from intersecting with the air exchanging hole (61), at an outer periphery of the extended portion (70), there are formed an ink introducing groove (71) formed continuously to the air exchanging hole (61), an extended-portion air groove (73) formed continuously to the partitioning-portion air groove (62) while being prevented from intersecting with the ink introducing groove (71) and an extended-portion temporary ink reserve groove (72) formed to intersect with the extended-portion air groove (73) and not to intersect with the ink introducing groove (71).

Here, a "collector (10)" refers to a constitution for adjusting the pressure change inside the ink tank (30).

Further, a "principal portion (50)" refers to a portion formed substantially similar to a total of the conventional collector (100). Further, a length from an end portion of the principal portion (50) on the side of the tip (20) to an end portion thereof on the side of the ink tank (30) is made to be formed to be substantially equal to a length from an end portion of the conventional collector (100) on the side of the tip (20) to an end portion thereof on the side of the ink tank (30).

Further, a "partitioning portion (60)" refers to a portion provided continuously to the principal portion (50) on the side of the ink tank (30).

Further, an "extended portion (70)" refers to a portion provided continuously to the partitioning portion (60) on the side of the ink tank (30).

That is, the collector (10) according to the invention is constituted by providing the partitioning portion (60) and the extended portion (70) continuously to the conventional collector (100) on the side of the ink tank (30) to thereby prolong a total length thereof.

Further, an "ink guide groove (51)" refers to a groove provided at the outer periphery of the principal portion (50) and formed from the side of the ink tank (30) to the side of the tip (20). Further, the ink guide groove (51) is formed not to communicate directly without side of the writing implement. That is, the ink guide groove (51) is formed substantially similar to the ink guide groove (130) provided at the conventional collector (100).

Further, a "principal-portion air groove (53)" refers to a groove provided at the outer periphery of the principal portion (50) and formed from the side of the tip (20) to the side of the ink tank (30) while being prevented from intersecting with the ink guide groove (51). The principal-portion air groove (53) communicates with outside of the writing implement. That is, the principal-portion air groove (53) is formed substantially similar to the air groove (140) provided at the conventional collector (100).

Further, "principal-portion temporary ink reserve groove (52)" refers to a groove provided at the outer periphery of the principal portion (50) and formed to intersect with the ink guide groove (51) and the principal-portion air groove (53). That is, the principal-portion air groove (53) is formed substantially similar to the temporary ink reserve groove (150) provided at the conventional collector (100).

Further, an "air exchanging hole (61)" refers to a groove having a small sectional area provided at the outer periphery of the partitioning portion (60) and formed continuously to the ink guide groove (51).

Further, a "partitioning-portion air groove (62)" refers to a groove provided at the outer periphery of the partitioning portion (60) and formed continuously to the principal-portion air groove (53) while being prevented from intersecting with the air exchanging hole (61).

Further, an "ink introducing groove (71)" refers to a groove provided at the outer periphery of the extended portion (70) and formed continuously to the air exchanging hole (61). Further, the ink introducing groove (71) communicates with the ink tank (30).

Further, an "extended-portion air groove (73)" refers to a groove provided at the outer periphery of the extended portion (70) and formed continuously to the partitioning-portion air groove (62) while being prevented from intersecting with the ink introducing groove (71). Further, the extended-portion air groove (73) is formed not to communicate directly with the ink tank (30).

Further, an "extended-portion temporary ink reserve groove (72)" refers to a groove provided at the outer periphery of the extended portion (70) and formed to intersect with the extended-portion air groove (73) and not to intersect with the ink introducing groove (71).

In this way, according to the collector (10) of the invention, although in view from the conventional collector (100), only the length of the portion in correspondence with the partitioning portion (60) and the extended portion (70) is extended, by providing the air exchanging hole (61) continuous to the ink guide groove (51) at the outer periphery of the partitioning portion (60), providing the ink introducing groove (71) continuous to the air exchanging hole (61) at the outer periphery of the extended portion (70), further, preventing the ink introducing groove (71) and the extended-portion temporary ink reserve groove (72) from intersecting with each other, there can be constituted the writing implement in which ink does not leak out from the front end of the tip (20).

Further the invention described in claim 7 in the invention is characterized in that, in addition to the constitution of the invention described in claim 6, the ink introducing groove (71) is formed such that a side thereof to the tip (20) is made shallow and a side thereof to the ink tank (30) is made deep.

For example, by inclining a bottom face (75) of the ink introducing groove (71), the side of the tip (20) can be made shallow, further, the side of the ink tank (30) can be made deep.

In this way, by forming the ink introducing groove (71) such that the side of the tip (20) is made shallow, further, and that the side of the ink tank (30) is made deep, air bubbles inside the ink introducing groove (71) are drawn swiftly to the ink tank (30).

Further, the invention described in claim 8 in the invention is characterized in that, in addition to the constitution of the invention described in claim 6 or 7, a face-cut portion (76) is formed at a surrounding of the ink introducing groove (71).

Here, a "face-cut portion (76)" refers to a portion formed in a shape of cutting off a surrounding of the ink introducing groove (71).

In this way, by providing the face-cut portion (76) at the surrounding of the ink introducing groove (71), ink is conducted between the face-cut portion (76) and the inner peripheral face of the ink containing cylinder (40) and, therefore, the ink introducing groove (71) is swiftly filled with ink.

BEST MODE FOR CARRYING OUT THE INVENTION

An explanation will be given to an embodiment of a writing implement according to the invention in reference to an illustrated example as follows.

Figure 1:
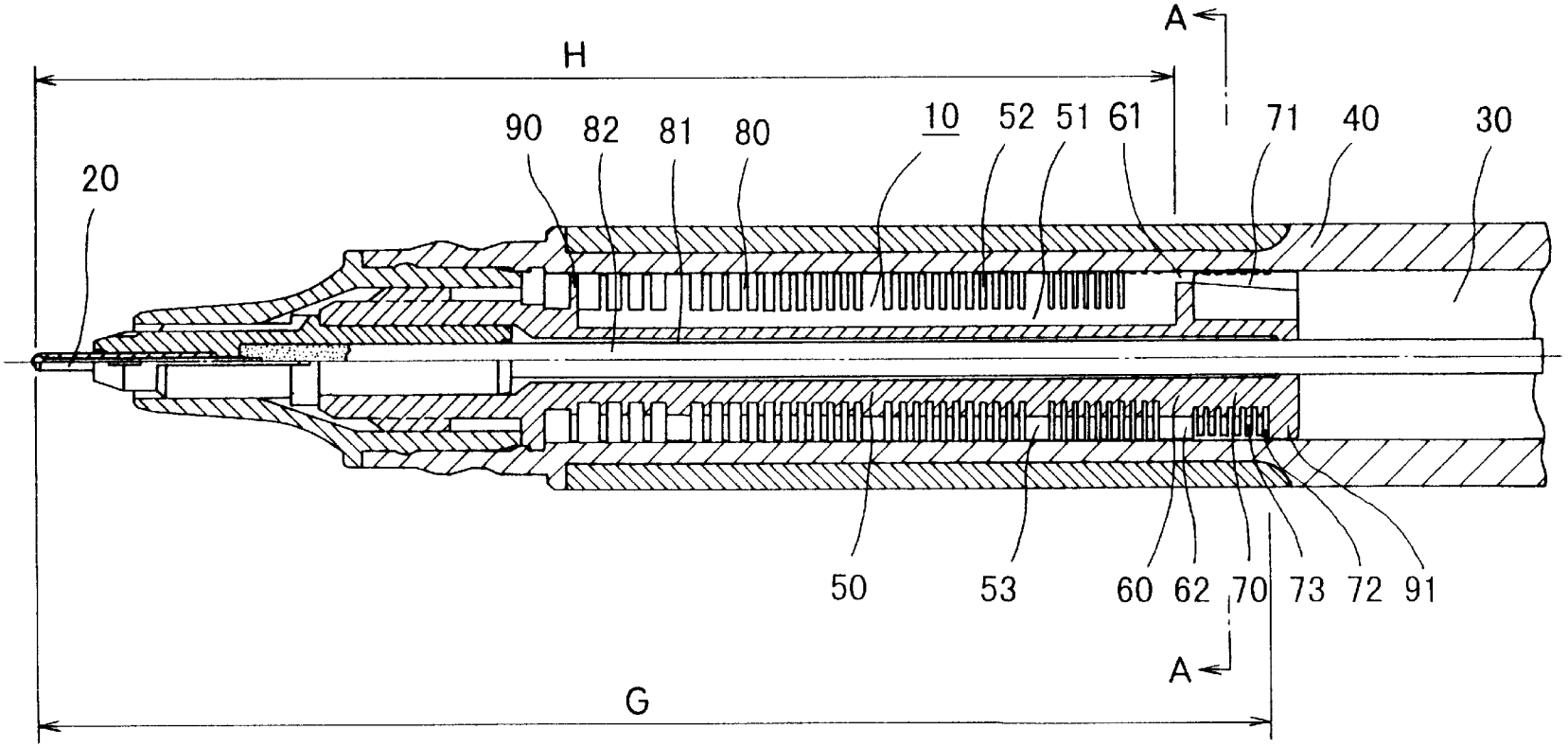
FIG. 1 is a sectional side view of essential portions of a writing implement according to an embodiment.

As shown in FIG. 1, a ballpoint pen constituting a writing implement according to the embodiment is provided with a collector 10 for adjusting pressure change inside an ink tank 30 between a tip 20 and the ink tank 30 to thereby form a temporary ink reserve part and an ink flowing portion and so on.

The collector 10 includes a principal portion 50, a partitioning portion 60 provided to the principal portion 50 on a side thereof to the ink tank 30 and an extended portion 70 provided continuously to the partitioning portion 60 on a side thereof to the ink tank 30.

Further, at an outer periphery of the principal portion 50, there are provided an ink guide groove 51 formed from a side of the ink tank 30 to a side of the tip 20, a principal portion air groove 53 formed from the side of the tip 20 to the side of the ink tank 30 while being prevented from intersecting with the ink guide groove 51 and a principal-portion temporary ink reserve groove 52 formed to intersect with the principal-portion air groove 53.

Further, at an outer periphery of the partitioning portion 60, there are provided an air exchanging hole 61 formed to be continuous to the ink guide groove 51 and a partitioning-portion air groove 73 formed to be continuous to the principal-portion air groove 53 while being prevented from intersecting with the air exchanging hole 61.

Figure 2:
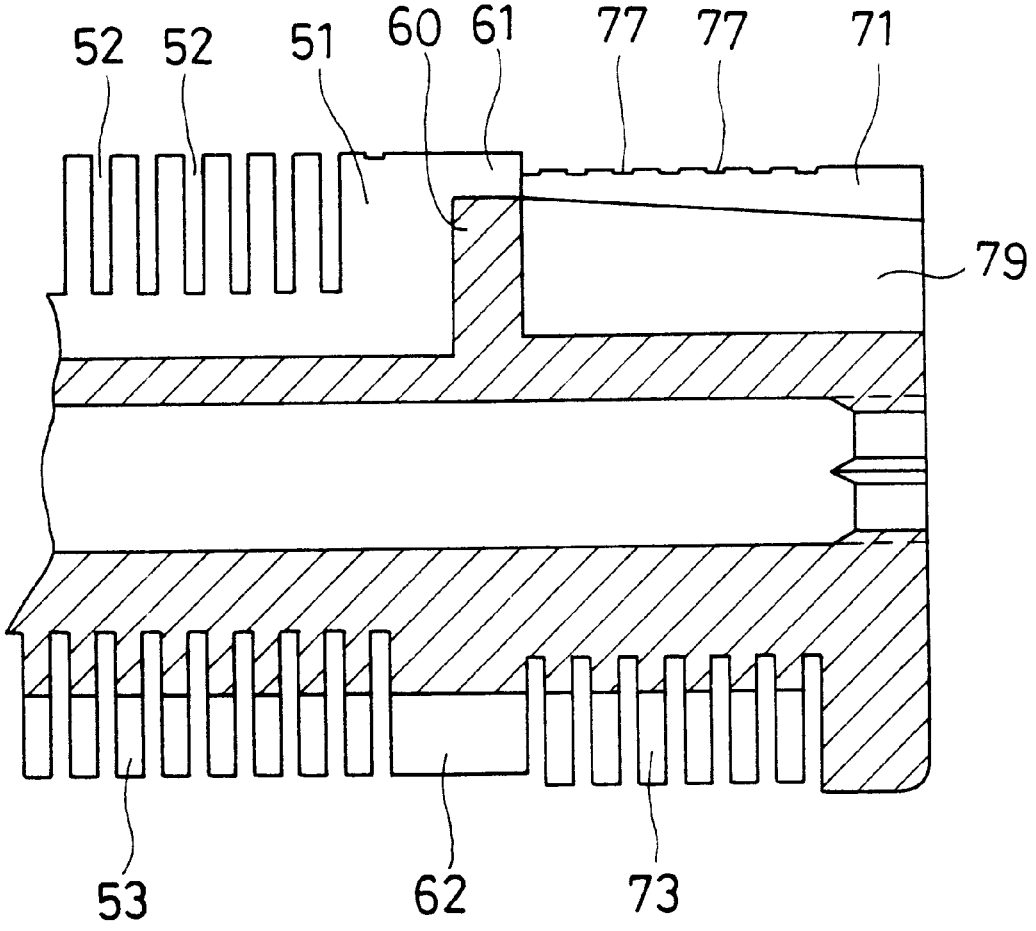
FIG. 2 is a sectional view enlarging a rear end portion of a collector according to the embodiment.

Further, as shown in FIG. 2, at an outer periphery of the extended portion 70, there are provided an ink introducing groove 71 formed continuously to the air exchanging hole 61 and an extended-portion air groove 73 formed continuously to the partitioning-portion air groove 73. Further, there is also provided an extended-portion temporary ink reserve groove 72 formed to intersect with the extended-portion air groove 73 and not to intersect with the ink introducing groove 71.

Further, at a center of the collector 10, there is provided an ink guide hole 81 penetrating from an end portion on a side of the ink tank 30 to an end portion on a side of the tip 20 and the ink guide hole 81 is inserted with an ink guide core 82 for guiding ink from the ink tank 30 to the tip 20 to thereby form an ink flowing portion.

Further, the ballpoint pen according to the invention is constituted such that even when a total length of the collector 10 is extended, ink is prevented from leaking out from a front end of the tip 20.

Further, the ballpoint pen according to the embodiment is provided with an ink containing cylinder 40 which is formed substantially in a shape of a circular cylinder and one end of which is closed. Further, the ink tank 30 and the like are formed by inserting the collector 10 from an opening portion of the ink containing cylinder 40.

Further, the collector 10 is provided with a number of fins 80 provided to narrow intervals therebetween and the principal-portion temporary ink reserve groove 52 and the extended-portion temporary ink reserve groove 72 are formed by gaps of the fins 80. Further, the ink guide groove 51, the principal-portion air groove 53 and the extended-portion air groove 73 are formed to penetrate the fins 80.

A further explanation will be given to the collector 10 as follows.

(Principal Portion 50)

The principal portion 50 is formed substantially similar to that of the conventional collector. Further, at an outer periphery of the principal portion 50, there are provided the principal-portion temporary ink reserve groove 52, the ink guide groove 51 and the principal-portion air groove 53.

Figure 6:
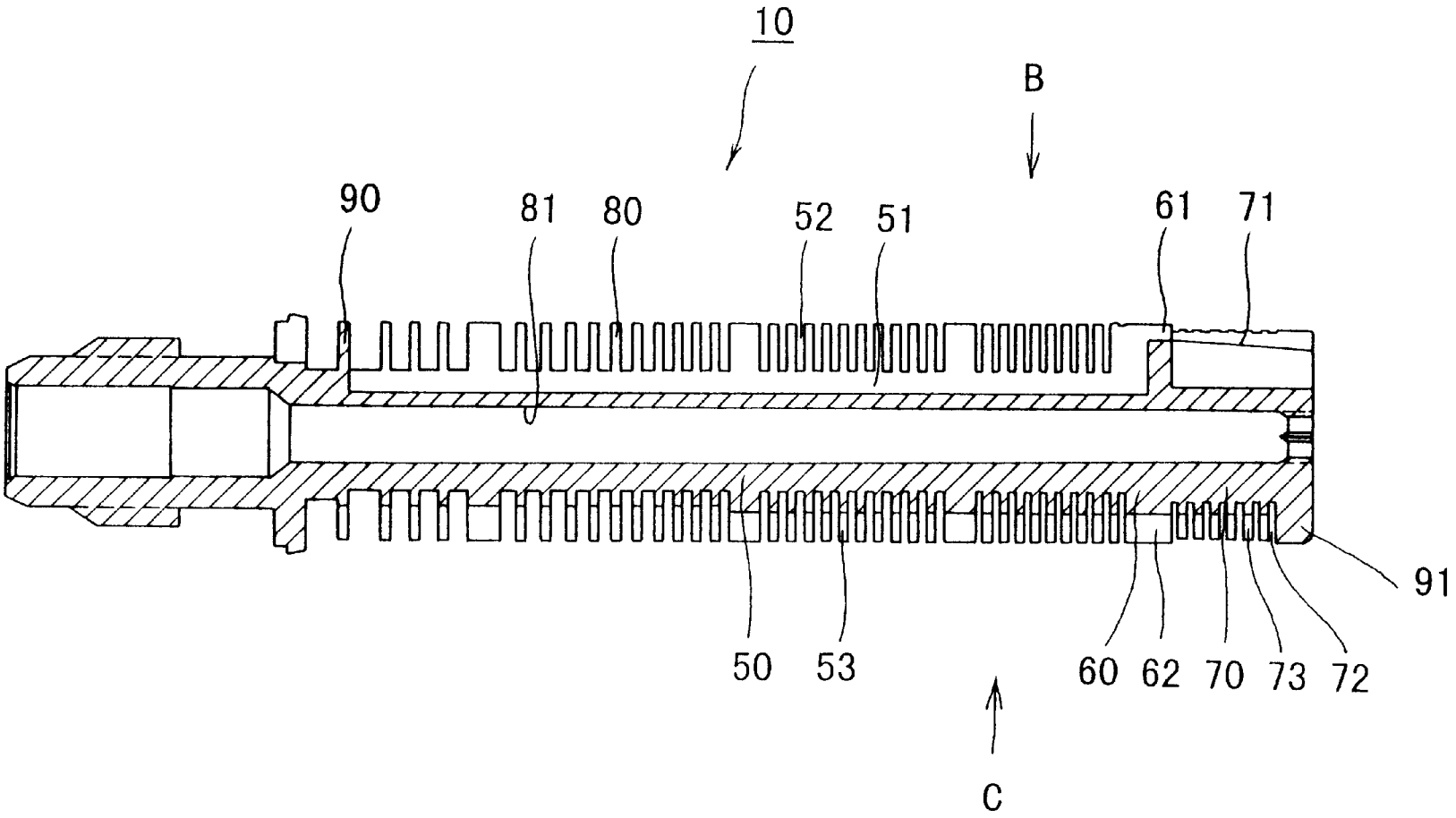
FIG. 6 is a sectional side view of the collector according to the embodiment.
Figure 7:
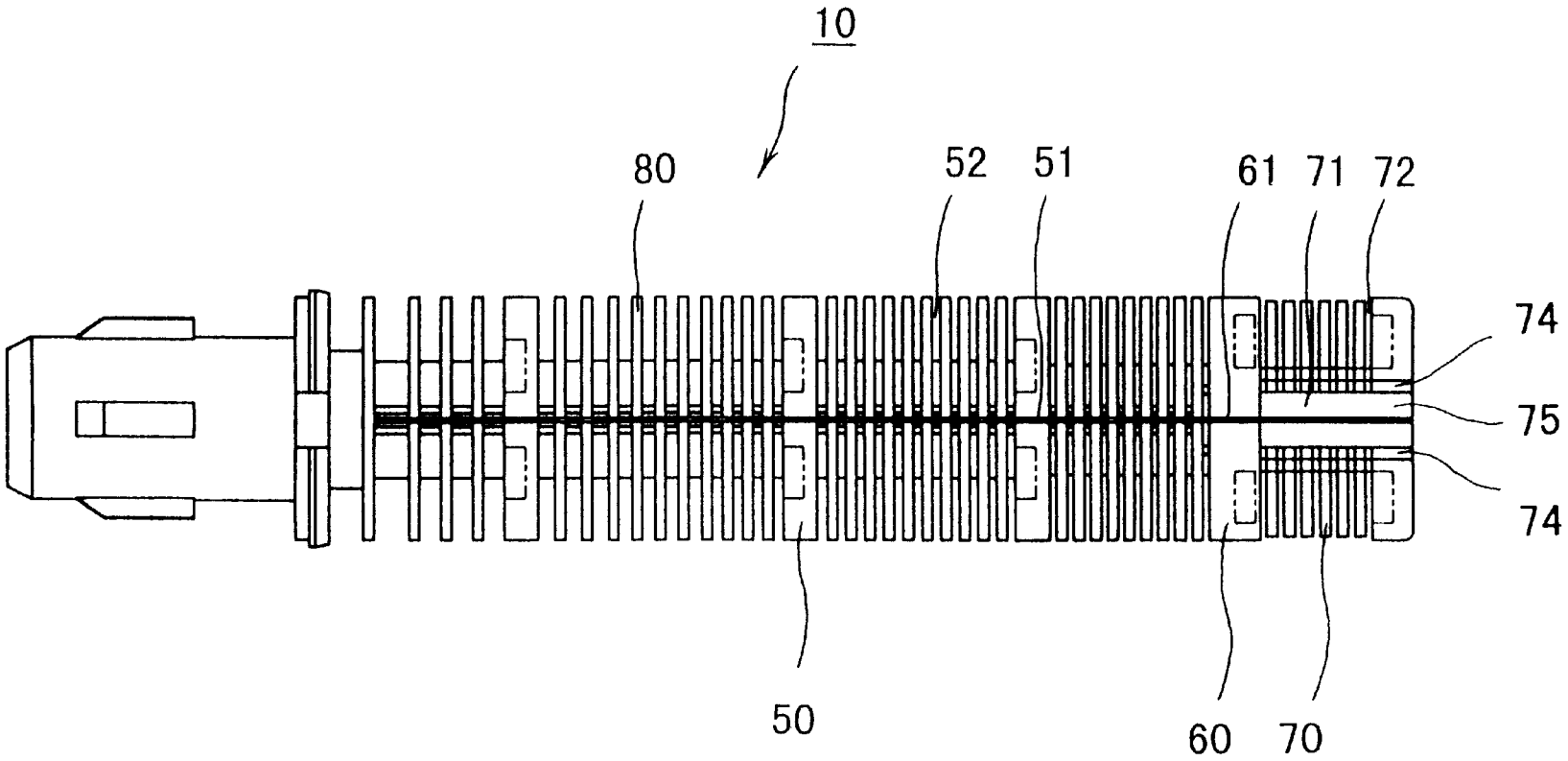
FIG. 7 is a side view of the collector viewed from an upper side (B side) of FIG. 6.
Figure 8:
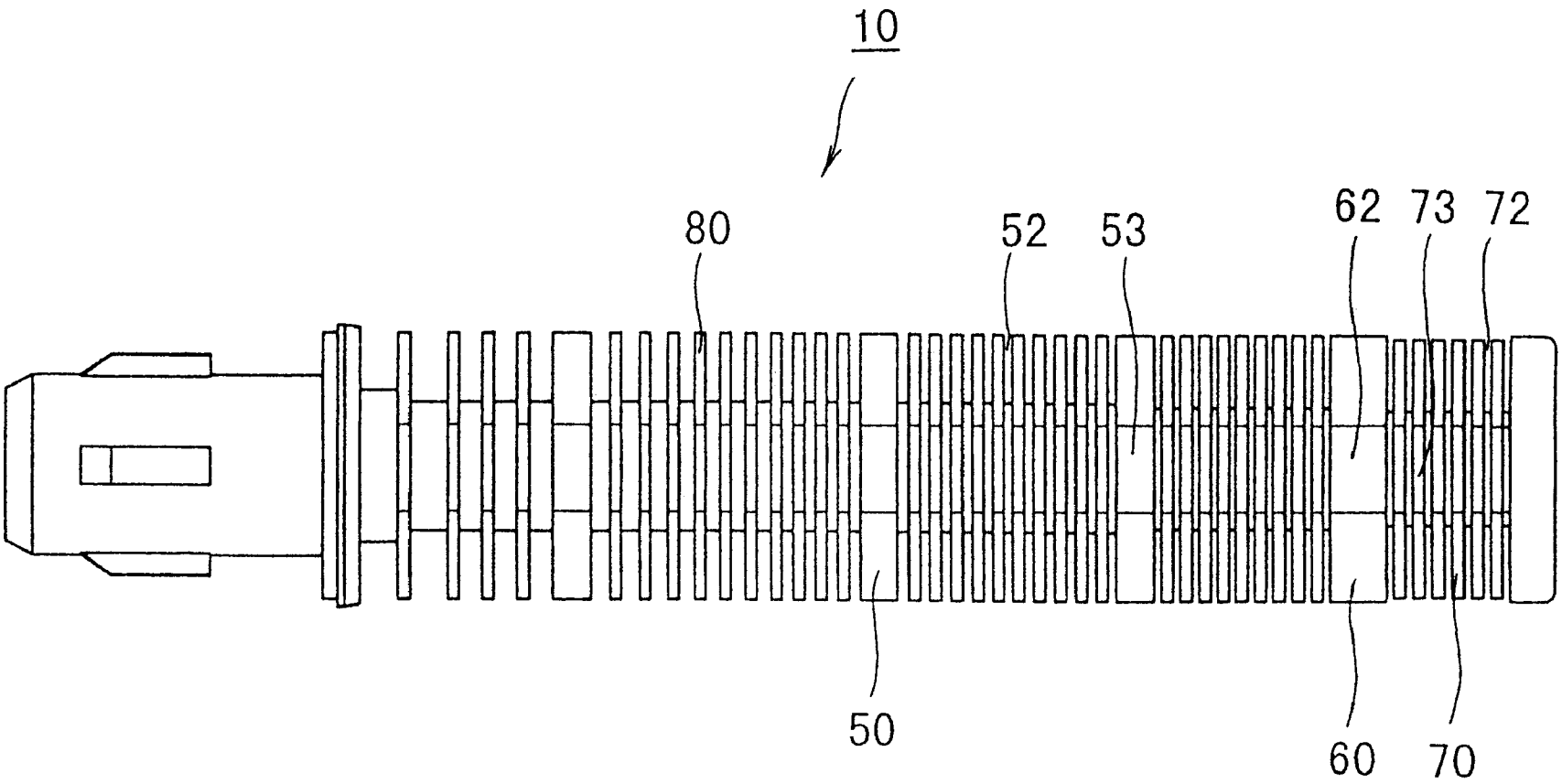
FIG. 8 is a side view of the collector viewed from a lower side (C side) of FIG. 6
Figure 9:
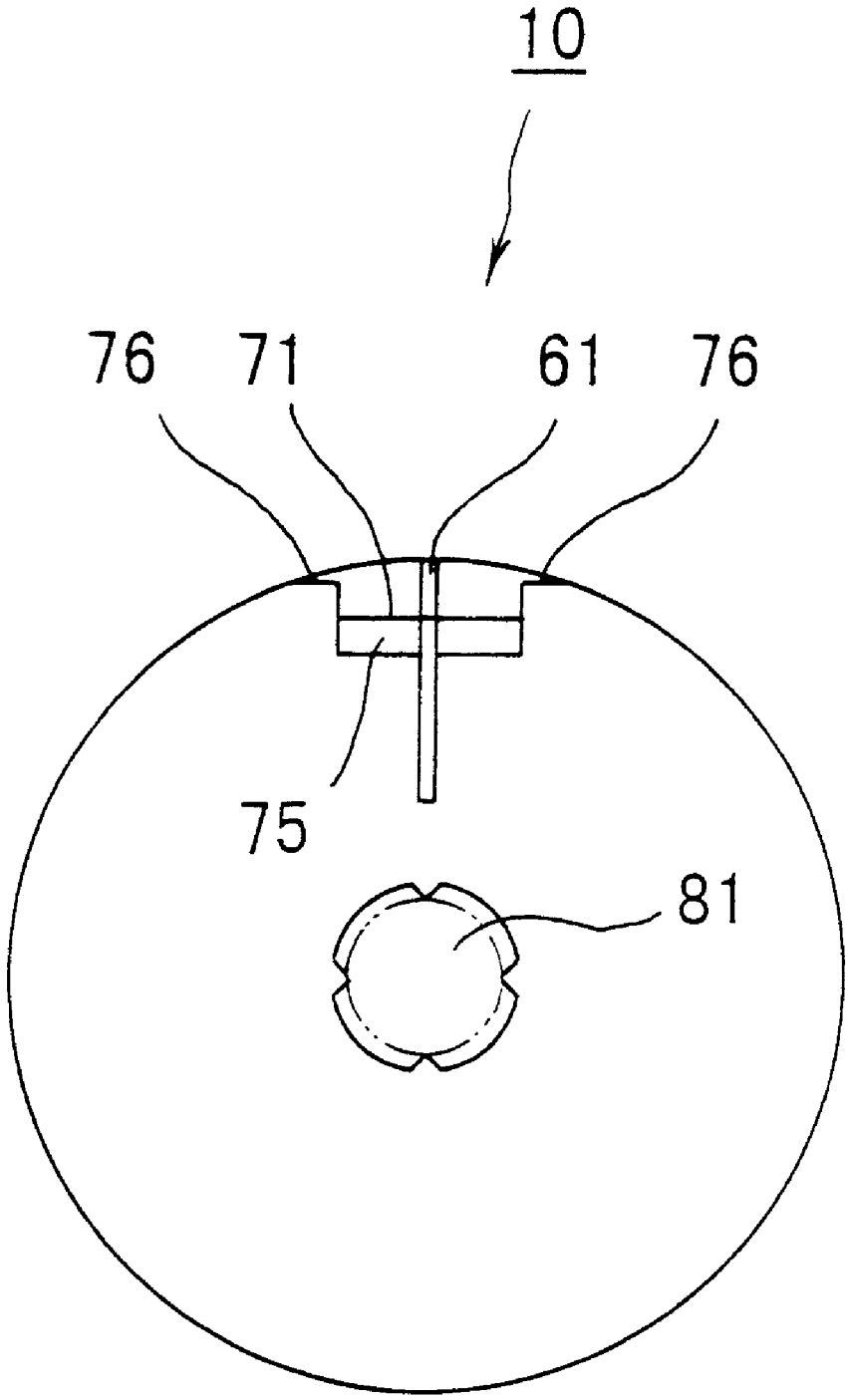
FIG. 9 is a plane view of the collector according to the embodiment viewed from a side of an ink tank. Further.
Figure 10:
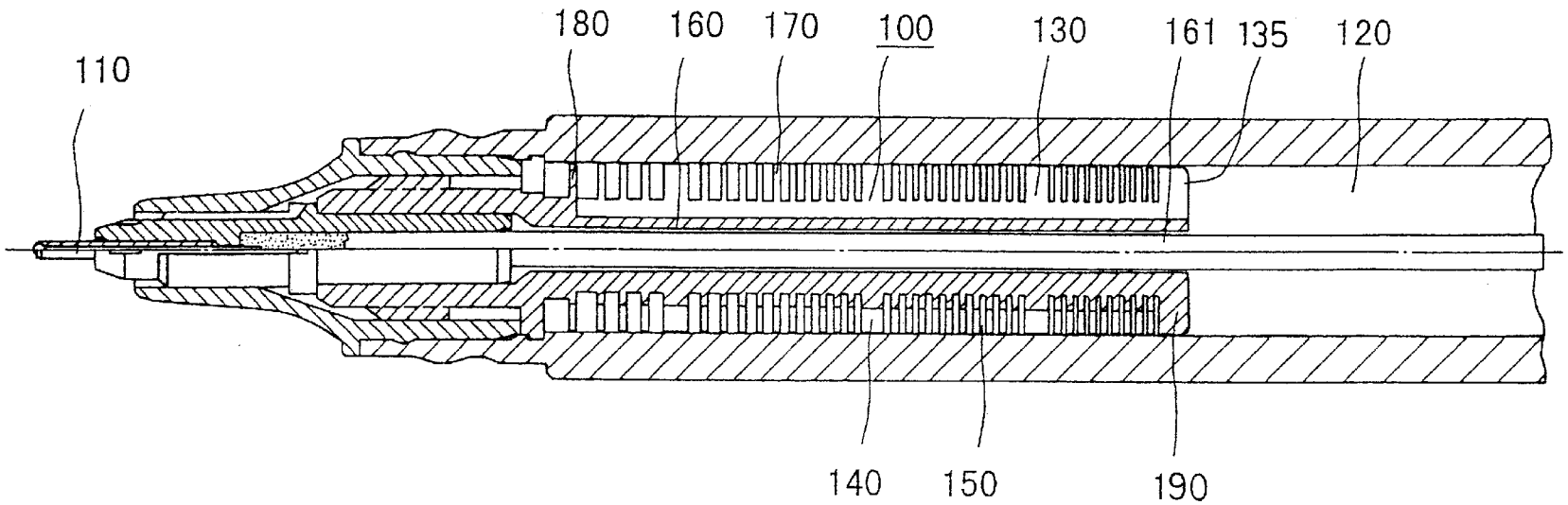
FIG. 10 is a sectional side view of an essential portion of a conventional ballpoint pen and FIG. 11 is a sectional side view of the conventional collector.
Figure 11:
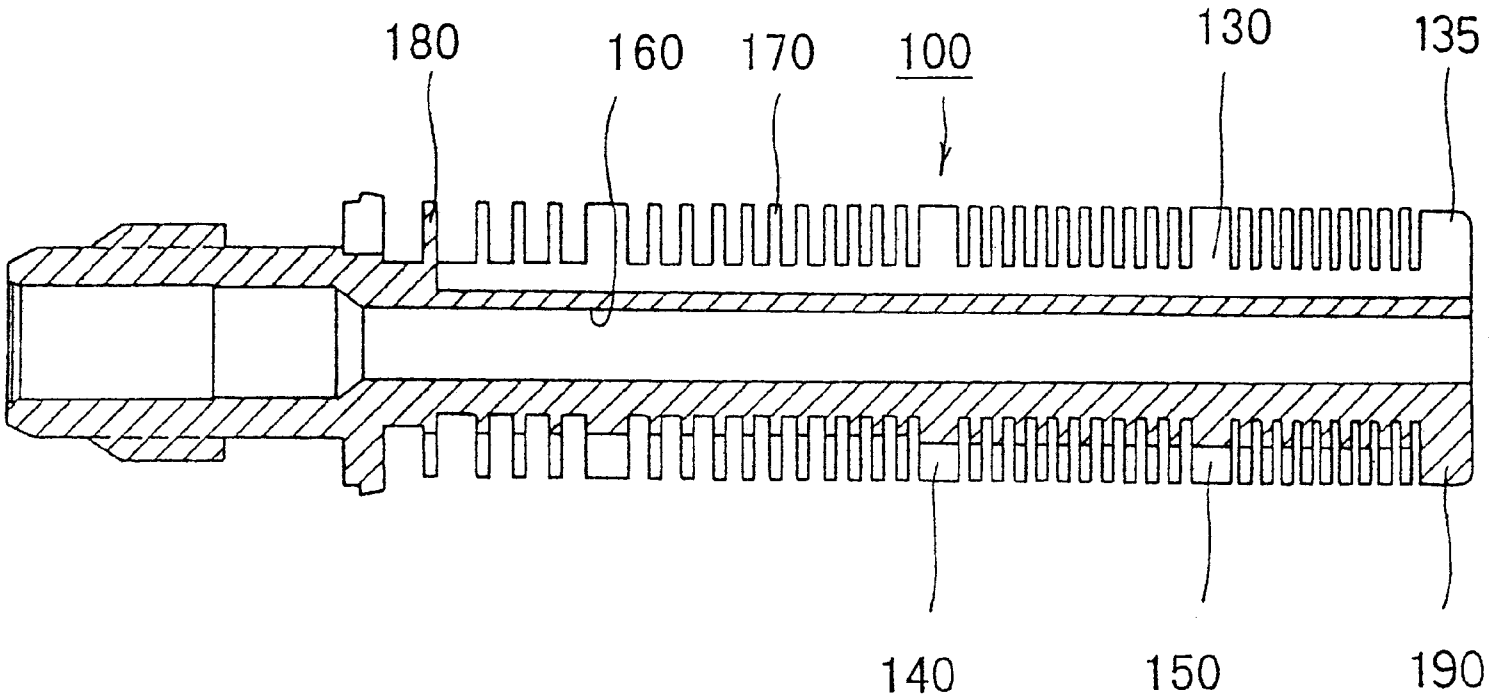

As shown in FIGS. 6 to 8, the principal-portion temporary ink reserve groove 52 is formed by the gaps of a number of the fins 80 provided by the collector 10.

Further, as shown in FIG. 6 or FIG. 7, the ink guide groove 51 is formed to penetrate a number of the fins 80 from the side of the ink tank 30 to the side of the tip 20 and communicates with the principal-portion temporary ink reserve groove 52. Further, at an end portion of the ink guide groove 51 on the side of the tip 20, there is provided a tip-side projecting portion 90 to thereby prevent the ink guide groove 51 from directly communicating with outside of the ballpoint pen. Further, a width of the ink guide groove 51 is formed to be narrower than a width of the principal-portion temporary ink reserve groove 52.

By making the width of the ink guide groove 51 narrower than the width of the principal-portion temporary ink reserve groove 52 in this way, boundary tension with ink at the ink guide groove 51 becomes stronger than boundary tension of the principal-portion temporary ink reserve groove 52. Therefore, while making ink present at the ink guide groove 51, ink flows into or is discharged from the principal-portion temporary ink reserve groove 52 via the ink guide groove 51.

Further, as shown in FIG. 6 or FIG. 8, the principal-portion air groove 53 is provided on a side opposed to the ink guide groove 51 in view from the ink guide hole 81 and is formed to penetrate a number of the fins 80 from the side of the tip 20 to the side of the ink tank 30 and communicates with the principal-portion temporary ink reserve groove 52. Further, the principal-portion air groove 53 communicates also with outside of the ballpoint pen. Further, by making the width of the principal-portion air groove 53 wider than the width of the principal-portion temporary ink reserve groove 52, the width is formed such that ink is not held by capillary force. Further, the principal-portion air groove 53 is formed as an air supply portion along with the extended-portion air groove 73, mentioned later.

(Partitioning Portion 60)

Further, the partitioning portion 60 is provided continuously to the principal portion 50 on a side thereof to the ink tank 30. Further, the air exchanging hole 61 is formed at an outer periphery of the partitioning portion 60 and the extended portion 70 is formed to the partitioning portion 60 on a side thereof to the ink tank 30.

As shown in FIG. 6 or FIG. 7, the air exchanging hole 61 is formed continuously to the ink guide groove 51. Further, a width of the air exchanging hole 61 is formed to be substantially equal to the width of the ink guide groove 51 and its depth is made shallower than a depth of the ink guide groove 51 to thereby form its section to be smaller.

(Extended Portion 70)

Further, the extended portion 70 is provided continuously to the partitioning portion 60 on a side thereof to the ink tank 30. Further, at an outer periphery of the extended portion 70, there are provided the ink introducing groove 71 connected to the extended-portion temporary ink reserve groove 72 and the air exchanging hole 61 and the extended-portion air groove 73 is provided continuously to the principal-portion air groove 53 connected to outside.

Figure 3:
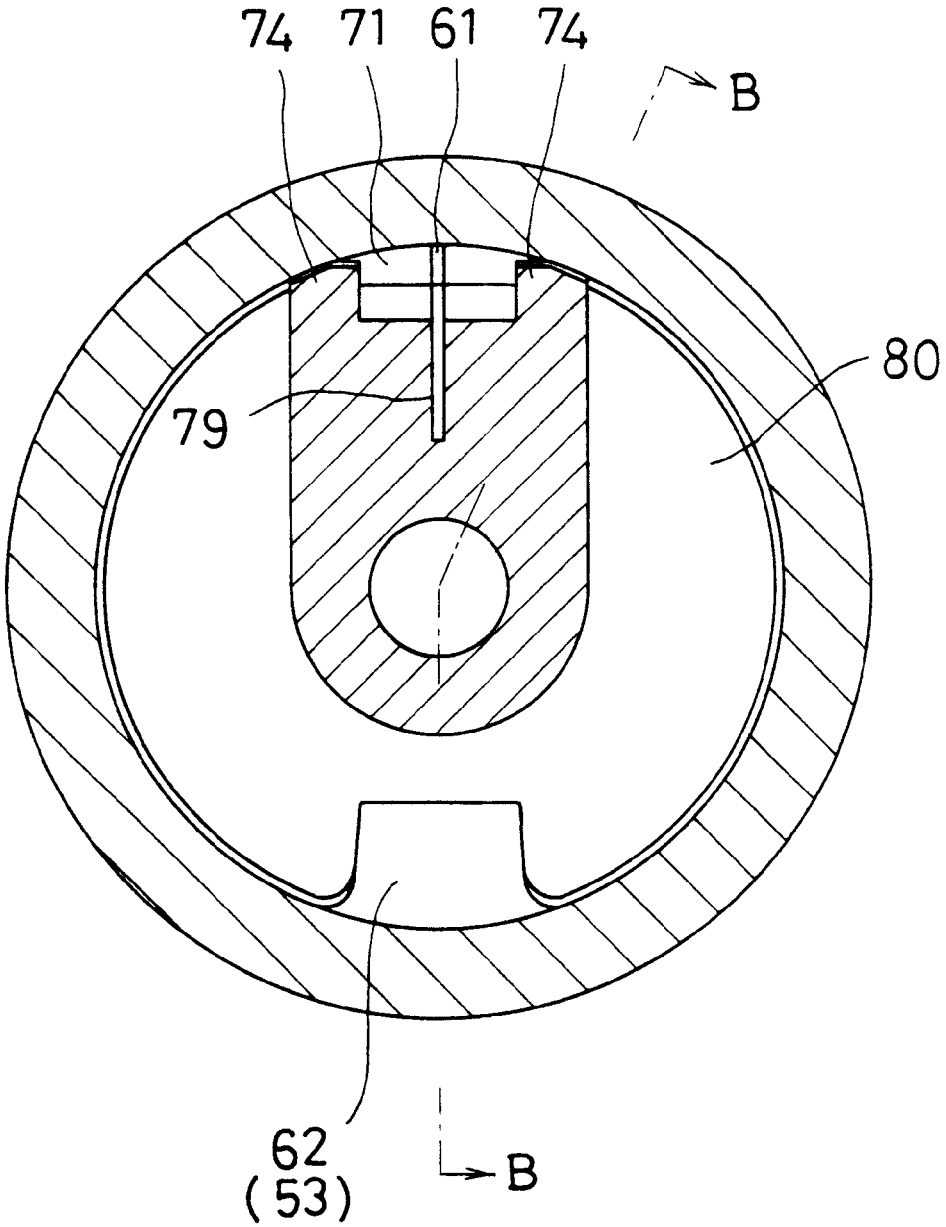
FIG. 3 is a sectional view taken along a line A—A of FIG. 1.

Further, as shown in FIG. 6 or FIG. 8, the partitioning-portion air groove 73 is provided on a side opposed to the air exchanging hole 61 in view from the ink guide hole 81 and is formed continuously to the principal-portion air groove 53. Further, a width and a depth of the partitioning-portion air groove 73 are formed to be substantially equal to a width and a depth of the principal-portion air groove 53 as shown in FIG. 3.

As shown in FIGS. 6 to 8, the extended-portion temporary ink reserve groove 72 is formed by the gaps of a number of the fins 80 provided by the collector 10.

Figure 4:
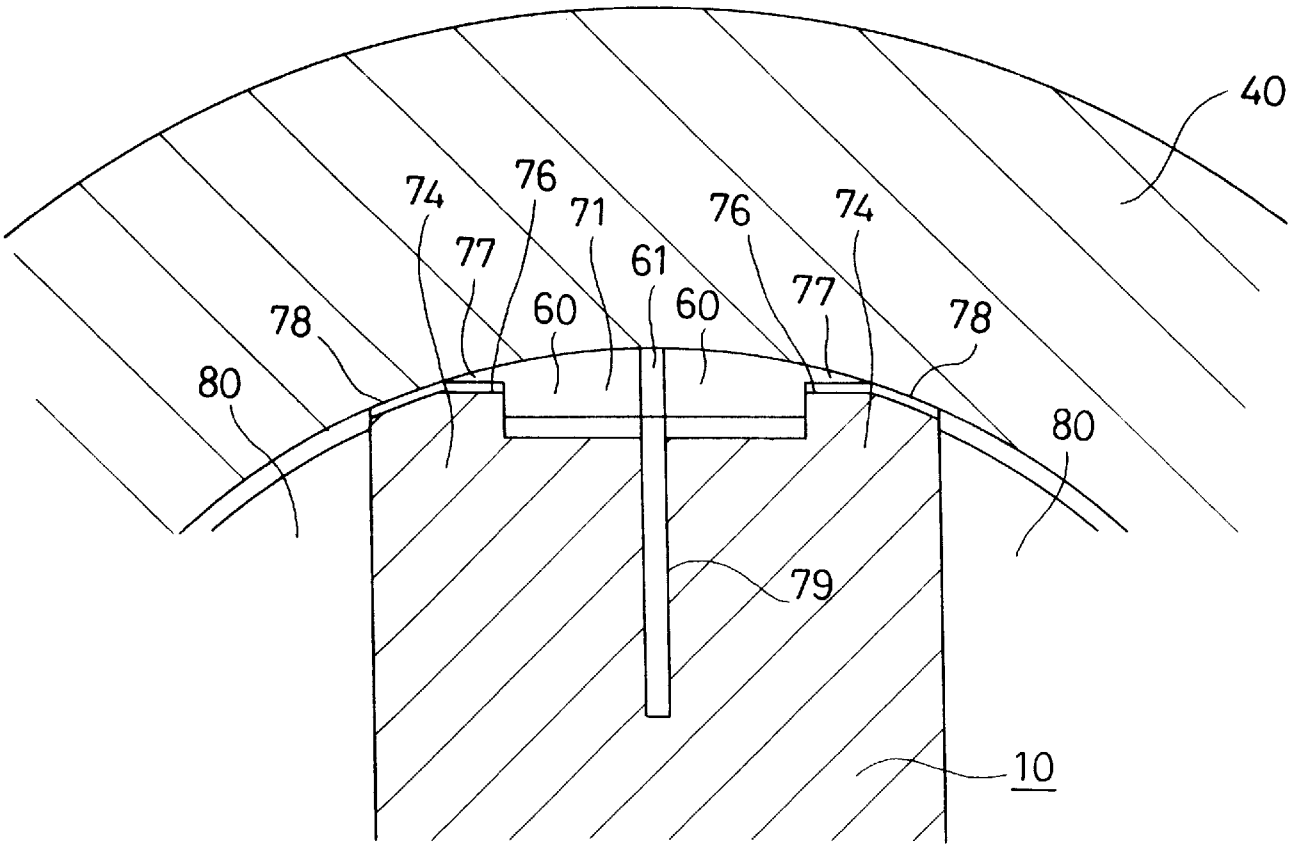
FIG. 4 is a view enlarging an essential portion of a section taken along the line A—A of FIG. 1.
Figure 5:
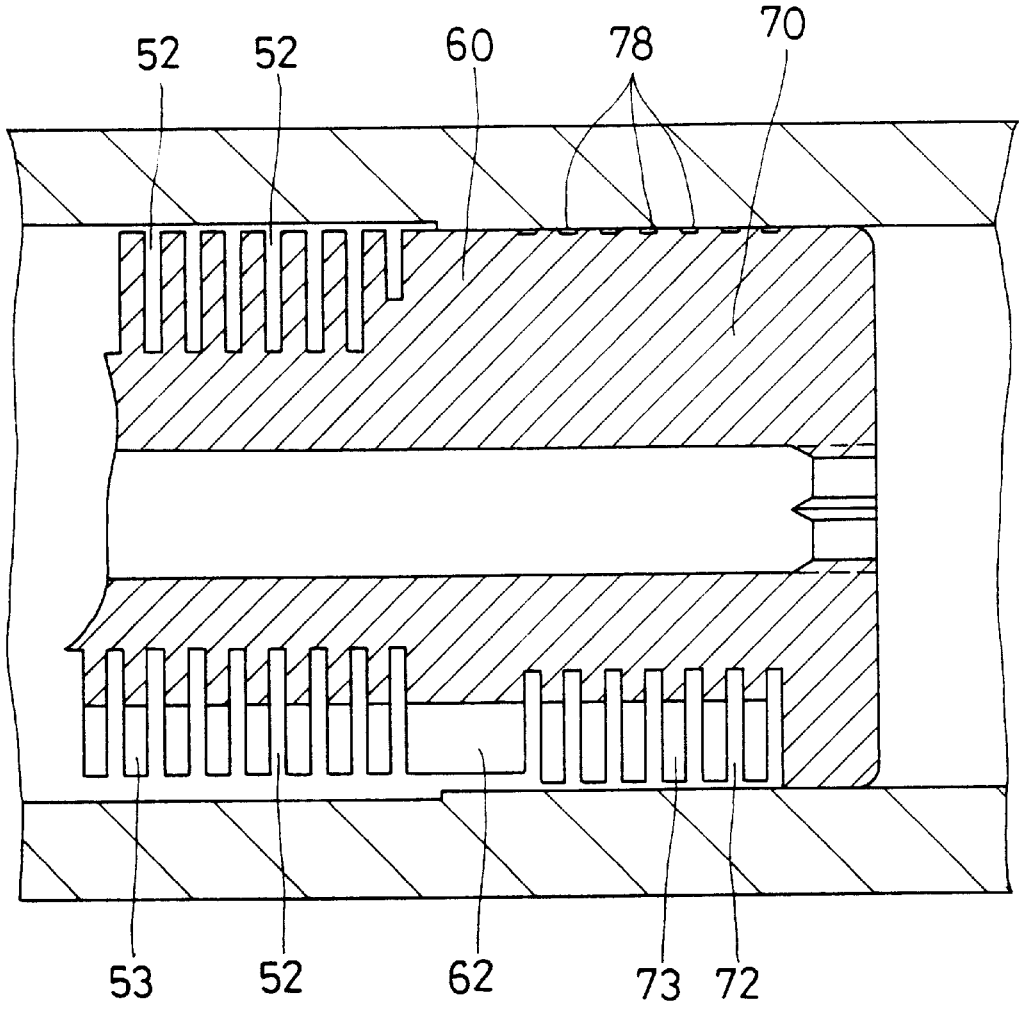
FIG. 5 is a sectional view taken along a line B—B of FIG. 3.

Further, as shown in FIG. 2, the ink introducing groove 71 is formed continuously to the air exchanging hole 61. Further, as shown in FIGS. 3 and 4, the ink introducing groove 71 is provided with partition walls 74 on both sides thereof by widening its width in a circumferential direction to thereby prevent the extended-portion temporary ink reserve groove 72 from communicating with the ink introducing groove 71 as it is. Further, the ink introducing groove 71 is formed to incline a bottom face 75 thereof such that the ink introducing groove 71 is narrower on the side of the tip 20 and deeper on the side of the ink tank 30. Further, at a surrounding of the ink introducing groove 71, there are provided face-cut portions 76 having a shape of cutting off the surrounding of the ink introducing groove 71 and between the ink introducing groove 71 and the ink containing cylinder 40, there are formed ink supply grooves 77 in a wedge-like shape over an entire length of the ink introducing groove 71. Further, a width of the ink introducing groove 71 is formed to be wider than the width of the ink guide groove 51 and the width of the air exchanging hole 61.

Further, at an outer periphery of the partitioning wall 74, there is formed a very small groove 78 having an extremely shallow depth and the ink introducing groove 71 and the extended-portion temporary ink reserve groove 72 are connected by the very small groove 78 having the very small section. Further, at a bottom portion of the ink introducing groove 71, there is provided an ink guide gap 79 by forming a slender gap directed to the center of the collector 10 over an entire length of the ink introducing groove 71.

Further, the extended-portion air groove 73 is provided on a side opposed to the ink introducing groove 71 in view from the ink guide hole 81 and is formed continuous to the partition portion air groove 73. Further, the extended-portion air groove 73 is formed to penetrate a number of the fins 80 and is communicated with the extended-portion temporary ink reserve groove 72. Further, at an end portion of the extended-portion air groove 73 on a side thereof to the ink tank 30, there is provided an ink-tank-side projecting portion 91 to thereby prevent the extended-portion air groove 73 from directly communicating with the ink tank 30. Further, a width and a depth of the extended-portion air groove 73 are formed to be substantially equal to the width and the depth of the partitioning-portion air groove 73.

Further, by inserting the collector 10 formed in this way into the ink containing cylinder 40, the ballpoint pen according to the embodiment is formed.

Further, according to the ballpoint pen of the embodiment, there is formed a very small gap between the outer periphery of the extended portion 70 and an inner peripheral face of the ink containing cylinder 40. Specifically, a gap between the outer peripheries of the portions of the partition walls 74 provided on the both sides of the ink introducing groove 71 and the inner peripheral face of the ink containing cylinder 40 is set to about 0.05 mm, further, a gap between an outer periphery of the fin 80 and the inner peripheral face of the ink containing cylinder 40 is set to about 0.1 mm. Further, in the gap between the outer periphery of the portion of the partition wall 74 and the inner peripheral face of the ink containing cylinder 40, owing to surface tension, although ink can pass there through, air cannot pass there through by meniscus of ink.

Next, an explanation will be given to the function or the like of the collector 10.

Ink inside the ink tank 30 is guided to the tip 20 normally by capillary force of the ink guide core 82 inserted into the ink guide hole 81.

Further, there is the case in which pressure inside the ink tank 30 is changed by elevating temperature of ink inside the ink tank 30 or the like by a change in temperature or a change in the atmospheric pressure of outside air, further, by body temperature of a person and the pressure inside the ink tank 30 is increased relative to the atmospheric pressure of outside air. When the pressure inside the ink tank 30 is increased, ink inside the ink tank 30 is conducted through the ink introducing groove 71, the air exchanging hole 61 and the ink guide groove 51 and reaches the principal-portion temporary ink reserve groove 52. Further, ink soaks also from the gap between the outer peripheries of the portions of the partition walls 74 provided on the both sides of the ink introducing groove 71 and the inner peripheral face of the ink containing cylinder 40 and ink which has soaked from the gap reaches the extended-portion temporary ink reserve groove 72. Therefore, even when pressure inside the ink tank 30 is increased, ink is not leaked out from the front end of the tip 20.

Further, there also is a case in which by consuming ink inside the ink tank 30, or by reducing temperature of the ink inside the ink tank 30 or the like or changing the atmospheric pressure of outside air, as the change in the pressure inside the ink tank 30, in comparison with the atmospheric pressure of outside air, the pressure is reduced relatively. In this case, ink inside the principal-portion temporary ink reserve groove 52 is conducted through the ink guide groove 51, the air exchanging hole 61 and the ink introducing groove 71 and flows into the ink tank 30 to thereby increase the pressure inside the ink tank 30. Further, also ink inside the extended-portion temporary ink reserve groove 72, soaks from the gap between the outer periphery of the portion of the partition wall 74 and the inner peripheral face of the ink containing cylinder 40 into the ink introducing groove 71, further, flows into the ink tank 30 to thereby increase the pressure inside the ink tank 30. Therefore, even when the pressure inside the ink tank 30 is changed and the pressure is reduced, ink which has soaked to the ink guide core 82 is not sucked up into the ink tank 30.

In the case in which when the pressure inside the ink tank 30 is further reduced, there is not present ink inside the principal-portion temporary ink reserve groove 52 and the extended-portion temporary ink reserve groove 72, air outside of the ballpoint pen is conducted through the principal-portion air groove 53, the principal-portion temporary ink reserve groove 52 and the ink guide groove 51 and reaches the ink introducing groove 71 from the air exchanging hole 61, further, flows into the ink tank 30 to thereby increase the pressure inside the ink tank 30.

At this occasion, ink is filled and forms a meniscus at the ink supply groove 77 formed at the gap between the outer periphery of the portion of the partition wall 74 and the inner peripheral face of the ink containing cylinder 40 to thereby seal the very small groove 78 reaching the extended-portion temporary ink reserve groove 72 by solution.

Therefore, outside air flowing into the principal-portion air groove 53 and the extended-portion air groove 73 constituting the air supplying portion, passes with certainty the air exchanging hole 61 from the principal-portion temporary ink reserve groove 52 via the ink guide groove 51 and flows into the ink tank 30 from the ink introducing groove 71.

Further, the ink introducing groove 71 is constituted by a wide groove having a wide width, enlarging more or less its section for preventing air bubbles of outside air flowing in from the air exchanging hole 61 having a small section from rising, further, the ink guide gap 79 is provided at the bottom portion of the ink introducing groove 71 and therefore, air bubbles easily rise at the ink introducing groove 71. Further, at this occasion, by the capillary force of the ink guide gap 79 constituting the slender gap, ink from the ink tank 30 is filled into the ink introducing groove 71 via the ink guide gap 79 and the ink introducing groove 71 can swiftly be filled with ink.

Therefore, even when the pressure inside the ink tank 30 is reduced, ink which has soaked to the ink guide core 82 is not sucked up to inside of the ink tank 30.

Further, air at outside of the ballpoint pen does not reach inside of the ink introducing groove 71 from the gap between the outer periphery of the portion of the partition wall 74 and the inner peripheral face of the ink containing cylinder 40 by being conducted through the extended-portion air groove 73 and the extended-portion temporary ink reserve groove 72 and accordingly, pressure inside the ink tank 30 does not increase excessively and ink does not leak out from the front end of the tip 20.

In this way, the collector 10 provided to the ballpoint pen according to the embodiment achieves the function of stably supplying ink from the ink tank 30 to the tip 20 by adjusting the pressure change inside the ink tank 30. Further, according to the collector 10, although in view from the conventional collector, only a length at a portion in correspondence with the partitioning portion 60 and the extended portion 70 is extended, by providing the air exchange hole 61 continuous to the ink guide groove 51 at the outer periphery of the partitioning portion 60, providing the ink introducing groove 71 continuous to the air exchanging hole 61 at the outer periphery of the extended portion 70, further, by preventing the ink introducing groove 71 and the extended-portion temporary ink reserve groove 72 from intersecting with each other, ink is prevented from leaking out from the front end of the tip 20.

Therefore, by extending the total length of the collector 10, there is constituted the ballpoint pen in which ink does not leak out from the front end of the tip 20 by promoting a capability of adjusting the pressure change inside the ink tank 30.

Further, by forming the ink introducing groove 71 such that the side of the tip 20 is made shallow, further, the side of the ink tank 30 is made deep, air bubbles inside the ink introducing groove 71 are swiftly drawn to the ink tank 30.

Further, by forming the face-cut portions 76 at the surrounding of the ink introducing groove 71, ink is conducted between the face-cut portion 76 and the inner peripheral face of the ink containing cylinder 40 and therefore, the ink introducing groove 71 is swiftly filled with ink.

Industrial Applicability

As explained above, according to the invention described in claims 1 and 4, there can be provided the writing implement of the direct liquid type preventing ink from leaking from the writing end.

Further, according to the invention described in claim 5, there can be fabricated and provided easily the writing implement for preventing ink from leaking.

Further, according to the invention described in claim 6, even when the total length of the collector is extended, ink can be prevented from leaking out from the front end of the tip.

Further, according to the invention described in claim 7, air bubbles inside the ink introducing groove are drawn swiftly to the ink tank.

Further, according to the invention described in claim 8, the ink introducing groove is swiftly filled with ink.

What is claimed is:

1. A writing implement of a direct liquid type comprising an ink tank, an ink flowing portion for connecting the ink tank and a writing end and for transmitting the ink to the writing end, a temporary ink reserve part for temporarily holding ink, and an air supplying portion for supplying air at the temporary ink reserve part, wherein the temporary ink reserve part comprises at least a temporary ink reserve groove and an ink guide groove;

the temporary ink reserve groove is constituted by a plurality of lateral grooves for temporarily holding ink by a capillary force;

the ink guide groove is constituted by a vertical groove for enabling to exchange air to inside of the ink tank via the temporary ink reserve groove while communicating the temporary ink reserve groove and the ink tank;

a portion of the ink guide groove on a side thereof to the ink tank is constituted by an ink introducing groove constituting a wide groove;

the ink introducing groove is formed by a slender groove communicating with a number of the temporary ink reserve grooves and forming a meniscus by ink, and the ink introducing groove constituted by the wide groove for releasing ink from a capillary force of the slender groove and formed from a side of the ink tank by an arbitrary length;

a portion at a boundary between the wide groove and the slender groove constitutes an air exchanging hole having a small section;

the ink introducing groove constituting the wide groove is of a size to a degree by which a coagulating force of an ink solution produced inside the wide groove does not hamper air bubbles supplied from the air exchanging hole constituting the boundary portion from being floated up;

a total of an opening portion to the temporary ink reserve groove communicated from the ink introducing groove constituted by the wide groove is constituted by a very small groove having a very small section and is made airtight by a meniscus of ink;

a meniscus of the air exchanging hole is easy to destruct more than the meniscus of the very small groove constituting the opening portion of the temporary ink reserve groove; and a distance G from the writing end to an end portion of the temporary ink reserve groove on a side thereof to the ink tank and a distance H from the writing end to the ink introducing groove of the ink guide groove, is brought into a relationship shown below:

$G>H$.

2. A writing implement according to claim 1, which has a slender gap as an ink guide gap at a bottom portion of the ink introducing groove constituted by the wide groove.

3. A writing implement according to claim 2, wherein the ink introducing groove constituted by the wide groove and the temporary ink reserve groove opened to the ink introducing groove constituted by the wide groove are separated by a partition wall forming an opening portion to the wide groove by a very small interval communicating with the temporary ink reserve groove;

a corner portion of the partition wall on a side thereof to the wide groove is subjected to face-cutting; and the ink supply groove is formed by an apex portion of a wedge-shaped space formed by the face-cut portion and an inner face of an ink containing cylinder.

4. A writing implement according to claim 1, wherein the ink introducing groove constituted by the wide groove and the temporary ink groove opened to the ink introducing groove constituted by the wide groove are separated by a partition wall forming an opening portion to the wide groove by a very small internal communicating with the temporary ink reserve groove;

a corner portion of the partition wall on a side thereof to the wide groove is subjected to face-cutting and the ink supply groove is formed by an apex portion of a wedge-shaped space formed by the face-cut portion and an inner face of an ink containing cylinder.

5. A writing implement which is a ballpoint pen having a collector for adjusting a change in a pressure inside an ink tank between a tip constituting a writing end and the ink tank, wherein the collector comprises a principal portion, a partitioning portion provided continuously to the principal portion on a side thereof to the ink tank and an extended portion provided continuously to the partitioning portion on a side thereof to the ink tank;

at an outer periphery of the peripheral portion, there is provided an ink guide groove, constituted by a slender groove forming a meniscus, formed from a side of the ink tank to a side of the tip, a principal-portion air groove formed from the side of the tip to the side of the ink tank while being prevented from intersecting with the ink guide groove, and a temporary ink reserve groove formed to intersect with the ink guide groove and the principal-portion air groove;

at an outer periphery of the partitioning portion, there is formed an air exchanging hole formed continuously to the ink guide groove and a partitioning-portion air groove formed continuously to the principal-portion air groove while being prevented from intersecting with the air exchanging hole; and at an outer periphery of the extended portion, there is formed an ink introducing groove formed continuously to the air exchanging hole and being of a size to a degree by which a coagulating force of an ink solution does not hamper air bubbles supplied from the air exchanging hole from being floated up, an extended-portion air groove formed continuously to the partitioning-portion air groove while being prevented from intersecting with the ink introducing groove, and an extended-portion temporary ink reserve groove formed to intersect with the extended-portion air groove and not to intersect with the ink introducing groove.

6. The writing implement according to claim 5, wherein the ink introducing groove is formed such that a side thereof to the tip is made shallow and a side thereof to the ink tank is made deep.

7. The writing implement according to claim 6, wherein a face-cut portion is formed at a corner position of an inner face of an ink containing cylinder of the ink introducing groove; and a wedge-shaped space is formed by the face-cut portion and the inner face of the ink containing cylinder from the side of the ink tank to the partitioning portion.

8. The writing implement according to claim 5, wherein a face-cut portion is formed at a corner position of an inner face of an ink containing cylinder of the ink introducing groove; and a wedge-shaped space is formed by the face-cut portion and the inner face of the ink containing cylinder from the side of the ink tank to the partitioning portion.

* * * * *